US007607699B2

(12) United States Patent
Langford

(10) Patent No.: US 7,607,699 B2
(45) Date of Patent: Oct. 27, 2009

(54) PORTABLE WORK CASE FOR SCRAPBOOKING

(76) Inventor: Brenda Langford, 4502 House of Lancaster, Austin, TX (US) 78730

( * ) Notice: Subject to any disclaimer, the term of this patent is extended or adjusted under 35 U.S.C. 154(b) by 490 days.

(21) Appl. No.: 11/353,884

(22) Filed: Feb. 14, 2006

(65) Prior Publication Data

US 2006/0192376 A1 Aug. 31, 2006

Related U.S. Application Data

(60) Provisional application No. 60/652,962, filed on Feb. 15, 2005.

(51) Int. Cl.

| | |
|---|---|
| ***B42D 3/00*** | (2006.01) |
| ***B42D 17/00*** | (2006.01) |
| *A45C 3/00* | (2006.01) |
| *B65D 25/04* | (2006.01) |
| *B65D 85/00* | (2006.01) |

(52) U.S. Cl. ..... 281/29; 281/44; 281/45; 190/110; 220/522; 220/529

(58) Field of Classification Search ..... 281/15.1, 281/22, 29, 33, 40, 44, 45; 190/102, 110, 190/114, 125; 206/308.1, 311, 312, 570, 206/575, 576, 579; 220/500, 522, 529; D19/26, D19/28, 32; D3/201, 203.3, 206
See application file for complete search history.

(56) References Cited

U.S. PATENT DOCUMENTS

| | | | | |
|---|---|---|---|---|
| 1,733,388 | A * | 10/1929 | Piltzer | 40/391 |
| 1,987,496 | A | 1/1935 | Springborn | |
| 2,739,697 | A * | 3/1956 | Kuddes | 312/328 |
| 3,504,915 | A | 4/1970 | Walker | |
| 3,792,668 | A | 2/1974 | Ward | |
| 4,194,628 | A * | 3/1980 | Campos | 206/570 |
| 4,436,307 | A | 3/1984 | Caldwell | |
| 4,479,651 | A | 10/1984 | LaFleur | |
| 4,484,745 | A | 11/1984 | Sleeper | |
| 4,552,361 | A | 11/1985 | LaFleur | |
| 4,865,325 | A | 9/1989 | Stolz | |
| D326,279 | S * | 5/1992 | Logan | D19/36 |
| D332,466 | S * | 1/1993 | Logan | D19/36 |
| 5,219,168 | A | 6/1993 | Morris | |
| 5,388,689 | A * | 2/1995 | Kroop et al. | 206/214 |
| 5,538,248 | A | 7/1996 | Shillito et al. | |
| 5,642,883 | A | 7/1997 | Rioux | |
| 6,257,621 | B1 | 7/2001 | Smith | |
| D474,605 | S * | 5/2003 | Wolf | D3/321 |
| 6,959,806 | B2 * | 11/2005 | Barker | 206/6.1 |
| 2002/0121775 | A1 | 9/2002 | Sperry | |
| 2004/0026294 | A1 | 2/2004 | Platte, III | |
| 2004/0154944 | A1 | 8/2004 | Morisset | |

* cited by examiner

*Primary Examiner*—Dana Ross
*Assistant Examiner*—Pradeep C Battula
(74) *Attorney, Agent, or Firm*—John A. Fortkort; Fortkort & Houston P.C.

(57) ABSTRACT

A portable work case for scrapbooking and other crafts is provided herein. The work case (101) comprises (a) a central portion (103) having first and second opposing sides, (b) a first lateral portion (105) hingedly attached to the first side of the central portion, (c) a first pad (111) releasably attachable to the first lateral portion, (d) a second lateral portion (107) hingedly attached to the second side of the central portion, and (e) a second pad (113) releasably attachable to the second lateral portion.

8 Claims, 3 Drawing Sheets

- PRIOR ART -

- PRIOR ART -

- PRIOR ART -

PORTABLE WORK CASE FOR SCRAPBOOKING

CROSS-REFERENCE TO RELATED APPLICATION

This application claims the benefit of priority from U.S. provisional patent application No. 60/652,962 filed Feb. 15, 2005 and bearing the title of "Portable Work Case for Scrapbooking".

FIELD OF THE DISCLOSURE

The present disclosure relates generally to scrapbooking devices and accessories, and relates more particularly to devices for facilitating the assembly of scrapbooks and for storing scrapbook works in progress.

BACKGROUND OF THE DISCLOSURE

Various devices exist in the art which are designed to facilitate arts, crafts, and hobbies by providing a suitable working surface for these projects and/or by providing storage for work pieces, supplies, or works in progress. For example, U.S. Pat. No. 1,987,496 (Springbom), U.S. Pat. No. 3,504,915 (Walker), U.S. Pat. No. 3,792,668 (Ward), U.S. Pat. No. 4,436,307 (Caldwell), U.S. Pat. No. 4,479,651 (LaFleur), U.S. Pat. No. 4,484,745 (Sleeper), U.S. Pat. No. 5,219,168 (Morris), U.S. Pat. No. 4,865,325 (Stolz), and U.S. Pat. No. 4,552,361 (LaFleur) all describe devices that can be used for assembling jigsaw puzzles and/or for storing jigsaw puzzles while they are in the process of being assembled.

While many hobbies have achieved a mature or steady-state status in the marketplace, there has been a recent and dramatic increase in consumer interest in scrapbooking as a hobby. Some of this increase is undoubtedly due to the advent of inexpensive, high quality color printers and desktop publishing and photo editing software, which allow consumers to easily and inexpensively design, customize and reproduce photographs and artwork on personal computers, and to print these documents on printers within the home. Consequently, scrapbooking has recently evolved into a multibillion dollar industry. At present, millions of people around the world are engaged in scrapbooking activities, either as a personal hobby or as members of scrapbooking clubs or organizations.

As scrapbooking has increased in popularity, a number of products have evolved that cater to the needs of scrapbook artists. Some of these products are designed to help scrapbook artists arrange, organize, work on, or store scrapbook projects or supplies. Examples of these devices are described in U.S. Pat. No. 6,257,621 (Smith) and in published patent applications U.S. 2002/0121775 (Sperry) and U.S. 2004/0026294 (Platte, III).

Another example of such a device is disclosed in U.S. Pat. No. 5,642,883 (Rioux), which discloses a device for holding and storing jig-saw puzzles. Although the patent itself does not mention scrapbooking, a commercial product is available which appears to be based on this invention. The product literature associated with the commercialized product (see, e.g., http://www.spilsbury.com/webapp/wcs/stores/servlet/ProductDisplay?catalogId=30001&storeId=10001&productId = 24870&langId=−1&parent_category_rn=11031&topcategory = 11031& categoryId = 11031&ref = spilsbury&wt.mc_id=60, downloaded on Jan. 9, 2005) notes that the product may also be used for scrapbooking.

The device 11 of Rioux comprises two co-extensive work panels 13, 15 that are hinged together along an axis so that the device can assume both a closed folded position as shown in FIG. 1, and an open coplanar position as shown in FIG. 2 in which the inner edges of the work panels form a smooth joint 17. A liner sheet covers, and is secured to, the panels and serves as a work surface upon which puzzle pieces can be assembled. Each of the work panels 13, 15 has associated therewith a generally co-extensive, flexible cover sheet to cover puzzle pieces 19 disposed on the liner sheet. The liner and cover sheets are made of a hook-and-loop type fastener fabric which permits the cover sheets to adhere to the liner sheet, thereby surrounding the partially assembled puzzle pieces 19 and preventing them from moving. When the pieces are being assembled, the cover sheet is rolled up and retained in an out-of-the-way position.

Each of the work panels 13, 15 is provided with respective drawers 21, 23 for the storage of individual puzzle pieces. Each of the work panels 13, 15 is used to assemble half of the completed puzzle, and the two halves are assembled across the smooth joint 17 of the two open coplanar panels. A foldable support 25 serves to maintain in a viewing position the picture of the completed puzzle on the cover of the puzzle container box. Latches 27 releasably retain the work panels 13, 15 and drawers 21, 23 in a closed position. The outer portions of the work panels 13, 15 contain handle components 31, 33 which together form a handle for carrying the device when it is in a closed configuration.

While the device of U.S. Pat. No. 5,642,883 (Rioux) may be adequate for its primary intended use in assembling jigsaw puzzles, it has some notable infirmities as a device to be used in scrapbooking. For example, this device has a limited surface area, and is thus not conducive for use in group projects or in assembling large or complicated projects. On the other hand, it is too bulky for use as a lap top device, or for placement on an end table or other piece of furniture where surface area is limited.

There is thus a need in the art for a device which overcomes these infirmities. In particular, there is a need in the art for a device which can be used in scrapbooking by either individuals or groups of people. There is further a need in the art for such a device which is conducive to lap top use and for placement on end tables and other pieces of furniture with limited surface area. These and other needs are met by the devices and methodologies disclosed herein and hereinafter described.

SUMMARY OF THE DISCLOSURE

In one aspect, a portable work case is disclosed herein which is useful for creating scrapbooks. The work case comprises a central portion having first and second opposing sides; a first lateral portion hingedly attached to said first side of said central portion; a first pad releasably attachable to said first lateral portion; a second lateral portion hingedly attached to said second side of said central portion; and a second pad releasably attachable to said second lateral portion.

In another aspect, a portable work case for creating scrapbooks is provided herein. The work case comprises a central portion having first and second opposing sides; a first lateral portion hingedly attached to said first side of said central portion; a first pad releasably attachable to said first lateral portion; a second lateral portion hingedly attached to said second side of said central portion; a second pad releasably attachable to said second lateral portion; first and second flaps hingedly attached, respectively, to third and fourth opposing sides of said central portion; and a compartmentalized tray removably positionable on said central surface; wherein said work case is movable from a first position in which the major surfaces of said first and second lateral portions are essentially parallel with the major surface of said central portion, to a second position in which the first and second major surfaces of said lateral portions are folded over said central portion.

In a further aspect, a portable work case for creating scrapbooks is provided. The work case comprises a central portion, a lateral portion hingedly attached to said central portion, and a pad releasably attachable to said lateral portion.

These and other aspects of the present disclosure are described in greater detail below with respect to the systems and methodologies described herein.

BRIEF DESCRIPTION OF THE DRAWINGS

For a more complete understanding of the systems and methodologies described herein and the advantages thereof, reference is now made to the following description taken in conjunction with the accompanying drawings in which like reference numerals indicate like features and wherein.

DETAILED DESCRIPTION

In accordance with the present disclosure, a device is provided which is useful for scrapbooking and other such hobbies, and which addresses the aforementioned needs in the art. This device provides greater working surface area than other devices of its type, is conducive for use by both individuals and groups, and lends itself to use as a lap top device or for placement on end tables or other such pieces of furniture where surface area is limited. Methodologies which are associated with, or enabled by, this device are also described.

Figure 1:
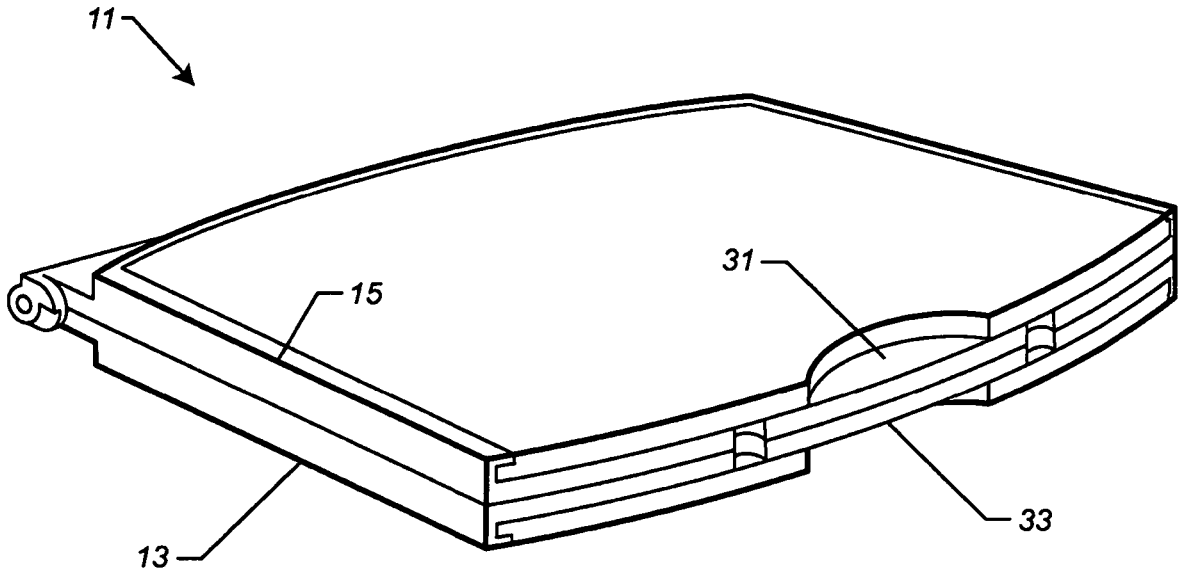
FIG. 1 is an illustration of a prior art puzzle holder device shown in a closed configuration.
Figure 2:
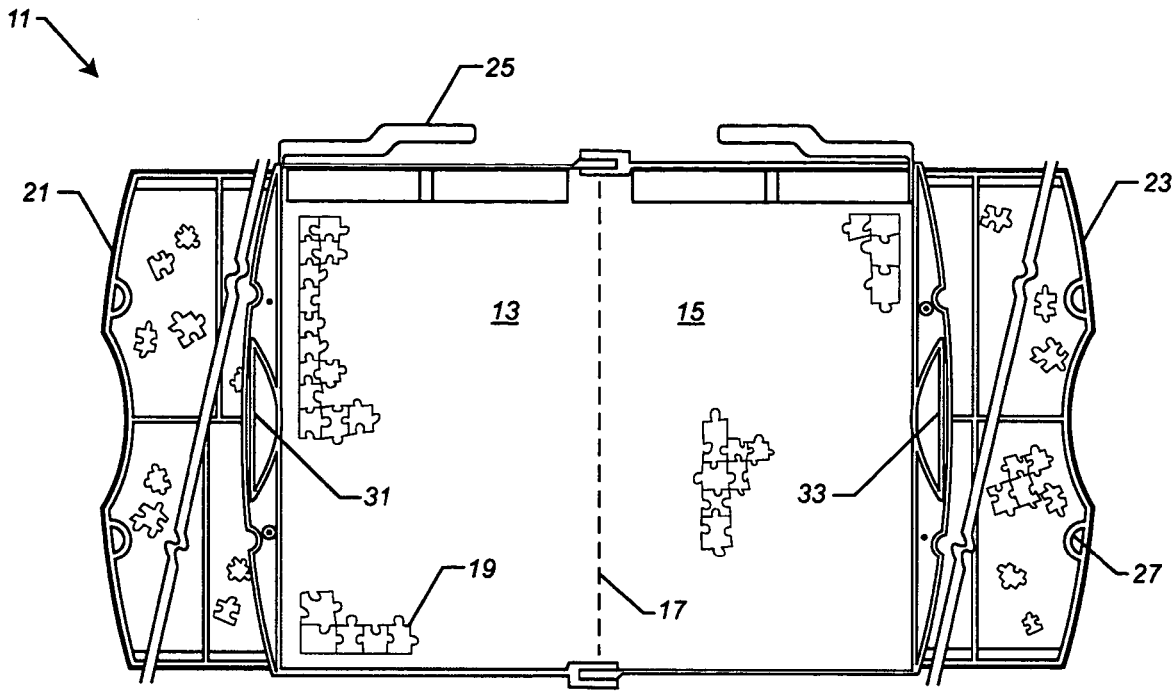
FIG. 2 is an illustration of the device of FIG. 1 in an open configuration.
Figure 3:
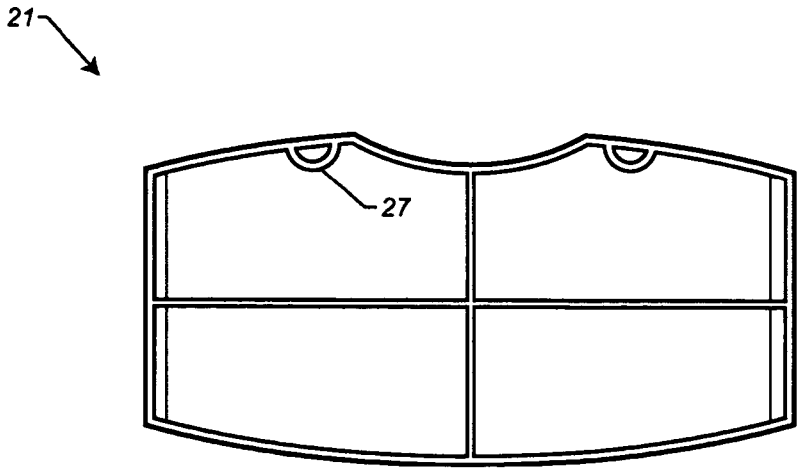
FIG. 3 is an illustration showing in greater detail a drawer for the device of FIG. 2.
Figure 4:
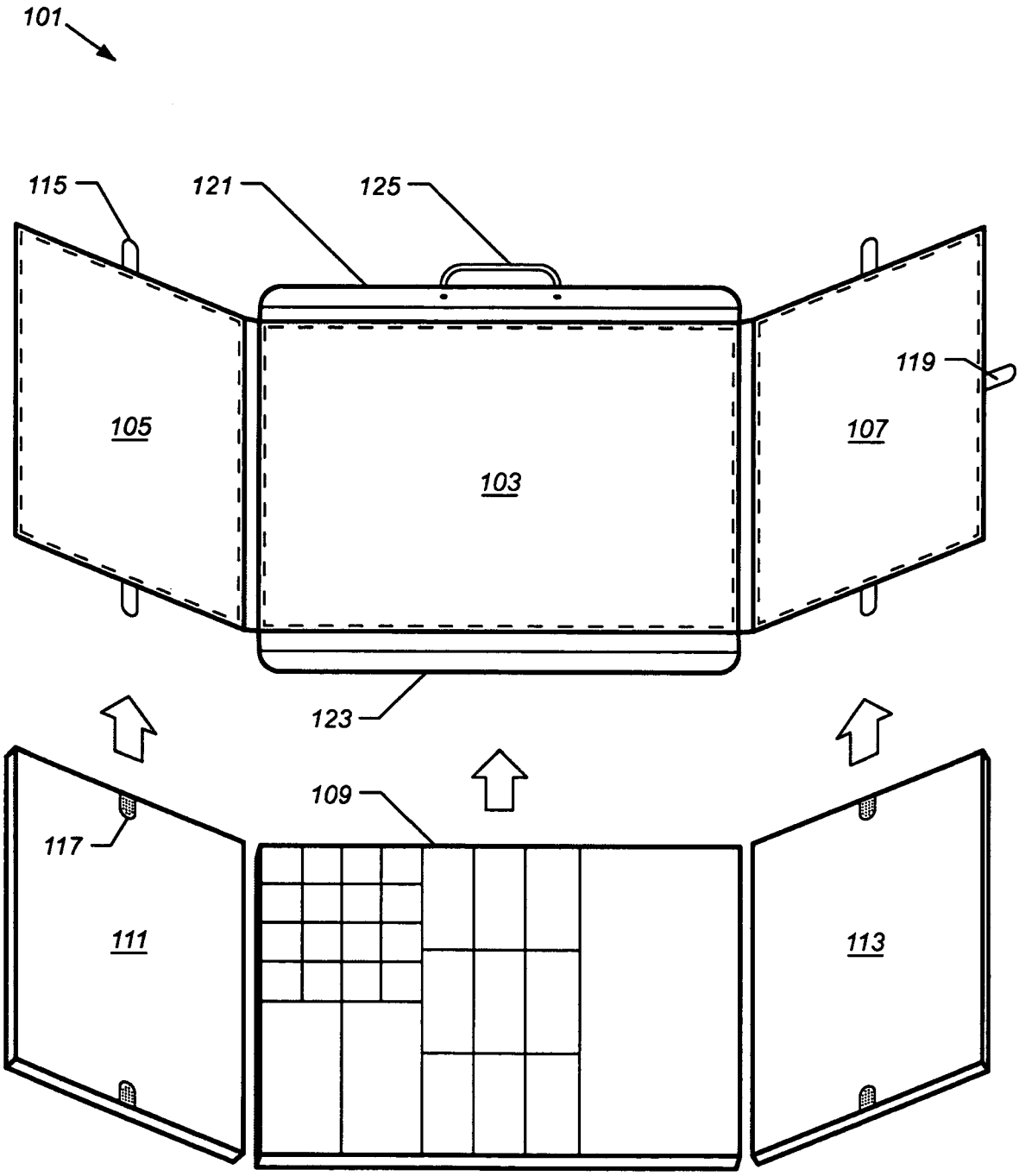
FIG. 4 is a work case made in accordance with the teachings herein.

FIG. 4 illustrates a first non-limiting embodiment of a device made in accordance with the teachings herein. The specific device illustrated is in the form of a work case 101 which comprises a central panel 103 having first 105 and second 107 lateral panels hingedly attached thereto. The work case is provided with a compartmentalized tray 109 which is removably positionable on the central panel 103, and first 111 and second 113 pads which are removably attachable to the first 105 and second 107 lateral panels, respectively, by way of a plurality of peripheral tabs 115. The peripheral tabs 115 preferably comprise releasable fasteners, such as hook-and-loop type fasteners, that releasably mate with a series of corresponding pads 117 of a suitable material that are provided on the surface of the first 105 and second 107 lateral panels. A central tab 119, which is preferably of the same or similar construction as peripheral tabs 115, is provided on the periphery of the second lateral panel 107, and releasably attaches to a corresponding pad (not shown) provided on the back surface of the first lateral panel 105 when the work case is in a closed configuration. Of course, it will be appreciated that other means or materials (e.g., repositionable adhesives) may be used to releasably fasten the first 111 and second 113 pads to the surfaces of the first 105 and second 107 lateral panels or to maintain the work case in a closed configuration, and that the devices disclosed herein are not limited to the use of any particular material or means for achieving this objective.

The central panel 103 of work case 101 is further provided with a top flap 121 and a bottom flap 123 which are hingedly attached to opposing sides of the central panel 103. The top flap 121 is further equipped with a handle 125 to facilitate carrying of the work case 101 when it is in a closed configuration. In some embodiments, an additional handle may be provided on the bottom flap. In other embodiments, one or both of the top and bottom flaps may be provided with a carrying strap, either in addition to, or in lieu of, a handle.

The work case 101 and its components can be designed with various dimensions. Preferably, however, the length of the central panel 103 is within the range of about 24 inches to about 48 inches, and more preferably is within the range of about 30 inches to about 42 inches. Most preferably, the length of the central panel 103 is about 36 inches. The width of the central panel 103 is preferably within the range of about 12 inches to about 36 inches, and more preferably is within the range of about 18 inches to about 30 inches. Most preferably, the width of the central panel 103 is about 24 inches. The depth of the central panel 103 (when the work case 101 is in a closed configuration) is preferably within the range of about 0.75 to about 3 inches, and is more preferably within the range of about 1 to about 2 inches. Most preferably, the depth of the central panel 103 is about 1.5 inches.

The dimensions of the first 105 and second 107 lateral panels may also vary, and need not be the same. Preferably, however, the first 105 and second 107 lateral panels are of essentially the same width as, and approximately half the length of, the central panel 103. The dimensions of the first 111 and second 113 pads may also vary. Preferably, however, the first 111 and second 113 pads have dimensions that are similar to, or slightly smaller than, the dimensions of the first 105 and second 107 lateral panels. Also, the compartmentalized tray 109 is preferably complimentary in its dimensions to the length, width and depth of the central panel 103. Consequently, when the compartmentalized tray 109 is disposed on the central panel 103 and when the first 111 and second 113 pads are disposed on the first 105 and second 107 lateral panels, the first 105 and second 107 lateral panels may be folded over it and secured in place with central flap 119 so that the work case and all of its components are secured in a compact form suitable for transportation.

Various materials may be used in constructing the various components of the devices disclosed herein. Preferably, the surfaces of the first 111 and second 113 pads, the surface of the central portion 103, and the surfaces of the first 105 and second 107 lateral portions comprise a material, such as felt or foamed rubber or plastic, which provides a suitable, preferably non-slip working surface of the type suitable for scrapbooking and other such hobbies. The central panel 103 and the first 105 and second 107 lateral panels are preferably constructed with a lightweight plastic core that has a tough outer surface comprising vinyl or other suitable materials.

The devices disclosed herein have a number of advantages over other devices that exist in the art and that may be used for similar purposes. For example, in the device of the present invention, the compartmentalized tray 109 and the first 111 and second 113 pads are removable and can be used independently of the rest of the work case 101. Consequently, these portions of the work case are adapted for lap top use or for placement on end tables and in other such areas where surface space is limited. Thus, for example, the user can use the work case to spread out a large scrapbooking project on a kitchen table or other suitable surface. The user can then work on a specific component of that project, while seated in a separate room, by placing that component on one of the removable pads 111, 113. The pad and work piece may then be positioned in the user's lap, on an end table, or in some other convenient place. This feature can be used in a similar fashion to allow a group of individuals to work together on a project without interfering with each other. It will be appreciated, of course, that, although the device is depicted with two pads, various embodiments may be made that include virtually any desired number of pads.

The provision of removable pads 111, 113 and a removable compartmentalized tray 109, along with the provision of a useful working surface under each of these items, also means that the devices disclosed herein may be disassembled into their component parts to provide a large aggregate working surface. This surface area can be further increased through the provision of additional pads. This feature allows the device to be used to work on large projects, and also further facilitates the use of the device by groups of individuals. Moreover, the pads can be made small enough so that they can be placed on a flatbed. scanner or other such device to permit scanning of a piece of artwork created or assembled on the surface of a pad (in some embodiments, the pads may be further provided with cover sheets so that, once photographs or other such items are assembled on their surface, the pad can be turned upside down without disrupting the assembly).

A further advantage of the devices disclosed herein is that these devices can be constructed with inherently simple designs that contain few, if any, mechanical parts. This feature allows these devices to be made at relatively low cost, while also increasing their expected lifetime. By contrast, devices such as those disclosed in U.S. Pat. No. 5,642,883 (Rioux) contain complex mechanical parts that are prone to mechanical failure.

A device has been provided herein which is useful for scrapbooking and other such hobbies. This device provides greater working surface area than other devices of its type, is conducive for use by both individuals and groups, and lends itself to use as a lap top device or for placement on end tables or other such pieces of furniture where surface area is limited.

The above description of the present invention is illustrative, and is not intended to be limiting. It will thus be appreciated that various additions, substitutions and modifications may be made to the above described embodiments without departing from the scope of the present invention. For example, while the devices and methodologies have been described herein primarily in reference to their use in scrapbooking, it will be appreciated that they are also have applications in other hobbies and tasks. Accordingly, the scope of the present invention should be construed in reference to the appended claims.

What is claimed is:

1. A portable work case for creating scrapbooks, comprising:

a central portion having first and second opposing sides;

first and second lateral portions having first and second major surfaces and being hingedly attached, respectively, to said first and second sides of said central portion;

first and second pads releasably attachable to said first and second lateral portions, respectively;

first and second flaps hingedly attached, respectively, to third and fourth opposing sides of said central portion; and a compartmentalized tray removably positionable on said central portion;

wherein each of said first and second lateral portions are equipped with a plurality of tabs which are releasably attachable to said first and second pads;

wherein said work case is movable from a first position in which the first and second major surfaces of said first and second lateral portions are extended from, and essentially parallel to, the major surface of said central portion, to a second position in which the first and second major surfaces of said lateral portions are folded over said central portion;

wherein said first and second flaps are movable into a position in which they overlap a portion of said tray and are disposed underneath said first and second lateral portions when the work case is in the second position;

wherein said first and second lateral portions abut along a seam when the work case is in the second position; and wherein said first lateral portion is equipped with a tab that extends across said seam and releasably attaches to a surface of said second lateral portion, thereby securing the work case in the second position.

2. The work case of claim 1, further comprising:

first and second flaps hingedly attached, respectively, to third and fourth opposing sides of said central portion.

3. The work case of claim 2, wherein said first flap is equipped with a handle.

4. The work case of claim 2, further comprising a compartmentalized tray removably positionable on said central portion.

5. The work case of claim 1, wherein said first and second lateral portions are rigid.

6. The work case of claim 1, wherein the surface of said central portion is equipped with a non-slip surface.

7. The work case of claim 1, wherein said central portion and said first and second lateral portions are movable into a position wherein they are essentially coplanar.

8. The work case of claim 1, wherein said work case is movable into a position in which it is essentially planar.

* * * * *